US006768086B2

(12) United States Patent
Sullivan et al.

(10) Patent No.: US 6,768,086 B2
(45) Date of Patent: Jul. 27, 2004

(54) TEMPERATURE SENSOR FOR A WARMING BLANKET

(75) Inventors: W. Mark Sullivan, Laurel, MS (US); Mitchell Brewer, Waynesboro, MS (US); Wayne Dearman, Laurel, MS (US); Armando Alvite, Miami Lakes, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 10/191,953

(22) Filed: Jul. 8, 2002

(65) Prior Publication Data

US 2004/0004070 A1 Jan. 8, 2004

(51) Int. Cl.[7] ..... H05B 1/02; H05B 3/34

(52) U.S. Cl. ..... 219/494; 219/212; 219/217; 219/528; 219/505

(58) Field of Search ..... 219/211, 212, 219/217, 494, 505, 545, 549, 546, 528, 544, 529, 402, 489, 492

(56) References Cited

U.S. PATENT DOCUMENTS

| | | | | |
|---|---|---|---|---|
| 3,222,497 A | | 12/1965 | Gordon, Jr. | |
| 3,683,151 A | | 8/1972 | Miles et al. | |
| 4,149,066 A | | 4/1979 | Niibe | |
| 4,251,717 A | | 2/1981 | Cole | |
| 4,277,670 A | | 7/1981 | Mori et al. | |
| 4,577,094 A | | 3/1986 | Mills | |
| 4,607,154 A | | 8/1986 | Mills | |
| 5,105,067 A | | 4/1992 | Brekkestran et al. | |
| 5,422,462 A | | 6/1995 | Kishimoto | |
| 5,451,747 A | * | 9/1995 | Sullivan et al. | 219/505 |
| 5,811,765 A | * | 9/1998 | Nakagawa et al. | 219/212 |
| 6,222,162 B1 | | 4/2001 | Keane | |
| 6,310,332 B1 | | 10/2001 | Gerrard | |
| 6,686,561 B2 | * | 2/2004 | Horey et al. | 219/494 |
| 2004/0026405 A1 | * | 2/2004 | Alvite et al. | 219/212 |

FOREIGN PATENT DOCUMENTS

JP 9-313325 12/1997

* cited by examiner

*Primary Examiner*—Tu Ba Hoang
(74) *Attorney, Agent, or Firm*—Lawrence J. Shurupoff

(57) ABSTRACT

A warming blanket having a temperature sensing element for sensing the temperature of the warming blanket. The temperature sensor may be a positive temperature coefficient (PTC) element that is threaded throughout the blanket. In one embodiment, the temperature sensing element runs perpendicular or transverse to the heating wires in the warming blanket, permitting the temperature sensing element to measure an average blanket temperature. In another embodiment, the heating element is supplied as a pair of buss wires extending along opposite sides of the warming blanket and having a number of heating wires extending therebetween. In this embodiment, the temperature sensing elements may run either parallel to or transverse to the heating elements. Temperature changes/signals in the temperature sensing element are sent to a microprocessor, which in turn changes the wattage of the heating elements to prevent overheating of the warming blanket.

24 Claims, 3 Drawing Sheets

TEMPERATURE SENSOR FOR A WARMING BLANKET

FIELD OF THE INVENTION

The present invention relates generally to fabrics, and more particularly to electric heating fabrics such as warming blankets.

BACKGROUND OF THE INVENTION

In general, a warming blanket, also called an "electric blanket," or an "electric heating blanket," is a blanket or another fabric material having an insulated electric heating element. The heating element is typically provided as one or more metallic wires threaded in a serpentine pattern throughout the blanket or arranged as a collection of parallel wires. The shape and size of the metallic wires varies, and in some cases the wires can actually be small metallic threads.

A warming blanket is typically plugged into a power outlet so that power may be supplied to the heating element, causing the production of heat. In this manner, the warming blanket may be a warm, comfortable cover used to warm a bed or may be wrapped around an individual as a heated, comfortable throw blanket, for example. A separate category of electrically heated bedding includes mattress pads. Mattress pads are typically placed under the warming blanket are utilized to warm the bed before use or to provide comfortable heat in the event the user does not wish to be covered with a fabric.

Contemporary warming blankets usually include a user control, such as a dial, that permits a user to set the amount of heat output of the blanket. This feature allows the consumer to set the blanket to a setting that offers the desired amount of heat for a particular temperature and in accordance with the comfort level of the individual.

SUMMARY OF THE INVENTION

The present invention provides a warming blanket having a temperature sensing wire threaded through the warming blanket to sense the temperature of the warming blanket. The warming blanket may alternatively be any type of warming fabric, such as a heated throw, mattress pad, heating pad, car seat heater, as examples. In accordance with one aspect of the present invention, the temperature sensor is a positive temperature coefficient (PTC) device that is threaded throughout the blanket fabric.

In accordance with one embodiment of the present invention, the temperature sensing wire runs transverse to the heating wires in the warming blanket. This feature permits the temperature sensing wire to measure an average blanket temperature, because the temperature sensing elements cross portions of the blanket that have heating wires, and portions that do not have heating wires.

In accordance with another embodiment of the present invention, the heating element is supplied as a pair of buss wires extending along opposite sides of the warming blanket and having a number of heating wires extending therebetween. In this embodiment, the temperature sensing elements may run either parallel to or transverse to the heating elements.

Information from temperature changes in the temperature sensing element of the present invention may be provided to a microcomputer so that the microcomputer may adjust the heat output of the heating element in the warming blanket.

In this manner, the temperature sensing wire and the microcomputer behave similar to a thermostat. If PTC is used as the heat-sensing material for the temperature sensing element, in one example a reference voltage (e.g., 5 volts) is applied to a length of the PTC element. Because resistance of the PTC material changes with changes in temperature, the current flowing through the PTC sensing element will increase or decrease as a result of temperature changes. The current change may be measured, and correlates with temperature changes in the PTC element, either locally or over long lengths of the sensing element.

In one embodiment of the invention, the end of the PTC sensing element opposite the end where voltage is applied is connected to a fixed resistor, which in turn is connected to ground. A voltage signal is tapped from a point between the PTC sensing element and the fixed resistor, and information about the voltage is sent to the microcomputer. As the temperature of the PTC sensing element increases, its resistance increases and in turn the voltage signal to the microcomputer decreases. The microcomputer may then, for example, decrease the amount of power supplied to the heating elements, or may cut the power to the heating elements altogether.

In accordance with one aspect of the present invention, the PTC sensing element is formed by extruding a PTC compound onto a nonmetallic core or carrier. As an example, the nonmetallic carrier is a polymeric material, such as a polyester core.

Because the core of the PTC temperature sensing wire is nonmetallic, the sensing element is flexible and has a thin profile. In addition, the sensing element is lightweight, and thus does not add significant bulk to a warming blanket. Moreover, since the temperature sensing elements cover the warming blanket, it is possible to detect localized overheating in the warming blanket, no matter where the localized heating may occur in the blanket.

The fixed resistor requires very little additional PC board area and may be added to existing warming blanket controls with little effort or cost. As such, adding the resistor and microcomputer to conventional warming blanket controls requires very little modification.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details. Furthermore, well-known features may be omitted or simplified in order to not obscure the present invention.

Figure 1:
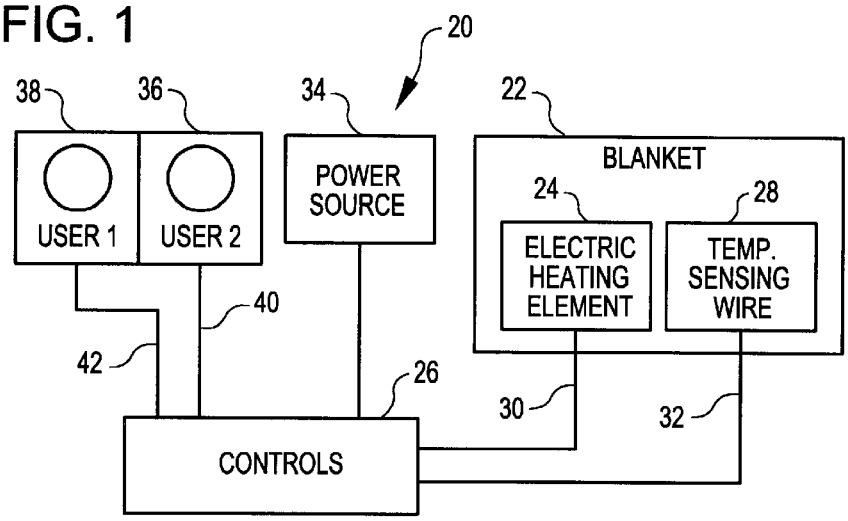
FIG. 1 is a block diagram representation of a warming blanket incorporating the present invention.

Referring now to the drawings, in which like reference numerals represent like parts throughout the several views, FIG. 1 shows a warming blanket 20 incorporating the present invention. The warming blanket 20 includes a blanket 22, made of a natural or synthetic material, such as a polyester/acrylic blend, or another suitable blanket or blend of material. Although a blanket is described with respect to the embodiment shown, the blanket 22 may alternatively be a throw or mattress pad, heating pad, a heated car seat or any other type of fabric that is to be heated.

An electric heating element 24 is included in the blanket 22, the construction and operation of which is known in the art. In general, a heating element is any device or structure that may produce heat using electrical power. For example, the heating element may be formed of resistive wires. A reference DC or AC voltage is applied across the resistive wires to cause them to increase in temperature. Although the drawings show DC voltages, an AC voltage may be used depending upon the design of the control.

A temperature sensing element 28 is also included in the warming blanket 20. In general, as is further described below, the temperature sensing element 28 is a device whose resistance varies with temperature. While the warming blanket 20 is described as having one temperature sensing element, an embodiment in accordance with the present invention may include two or more temperature sensing elements.

As an example, the temperature sensing element may be a wire extruded from positive temperature coefficient (PTC) material, such as a conductive, plastic, PTC compound. Example PTC temperature sensing elements are further discussed below.

The warming blanket 20 includes controls 26 connected to the temperature sensing element 28 and the electric heating element 24. A first power cord 30 leads from the controls 26 to the electric heating element 24, and a second power cord 32 leads to the temperature sensing element 28. A power source 34 is connected to the controls 26, and may be provided, for example, via a DC converter connected to an AC outlet, or via another DC source.

One or more user controls 36, 38 are provided, and are attached to the controls 26 via wires 40, 42, although a wireless connection may be used. The user controls 36, 38 may be mounted on the outside of a box for the controls, for example, and may be any type of configuration that permits a user to input a desired setting for the warming blanket 20, e.g., dials, slide bars, push-button indexing units with digital or LED displays, and so forth. In the embodiment shown in FIG. 1, two user controls 36, 38 are shown, which may be used, for example, on a blanket having two different heating zones. However, if a single zone blanket is used, then only one user control (e.g., 36) is needed, along with the corresponding wire (e.g., 40), or wireless connection, if relevant. Various other combinations may be configured by a person of skill in the art.

Briefly described, in accordance with one aspect of the present invention, the controls 26 and the temperature sensing element 28 are configured such that the temperature sensing element 28 supplies temperature information regarding the temperature of the blanket 22 to the controls 26, and the controls adjust the heat output of the blanket 22 according to the temperature information.

Figure 2:
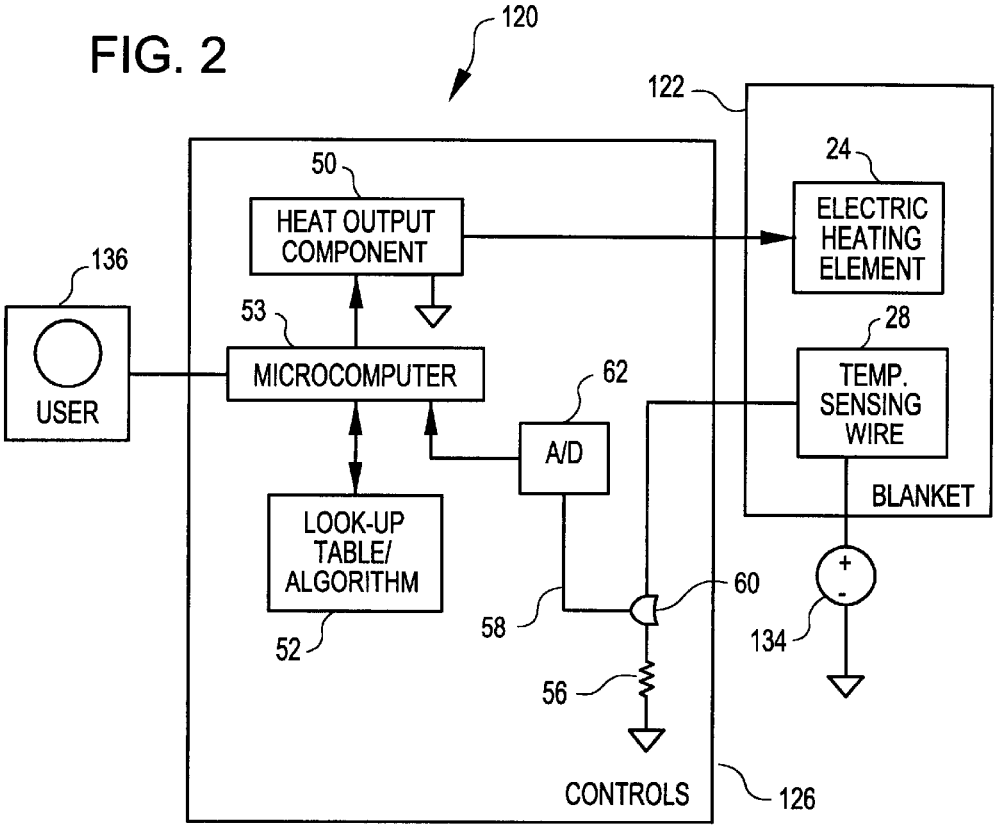
FIG. 2 is a block diagram representation showing detail of controls for the warming blanket of FIG. 1.

FIG. 2 shows an embodiment of a warming blanket 120 utilizing a single user control 136 with a blanket 122. The controls 126 for the shown embodiment are attached to a DC power source 134 and include a heat output component 50, a look-up table or algorithm 52, and a microcomputer 53. The microcomputer 53 is a standard control (i.e., a device or mechanism used to regulate or guide the operation of a machine, apparatus, or system) or other device that can execute computer-executable instructions, such as program modules. Generally, program modules include routines, programs, objects, components, data structures and the like that perform particular tasks or implement particular abstract data types.

The temperature sensing element 28 is attached at one end to a positive terminal of the power source 134. The opposite end of the temperature sensing element 28 is attached to a fixed series resistor 56. A wire 58 connects to the junction 60 of the resistor 56 and the temperature sensing element 28, and an A/D converter 62 is connected to the wire 58. The A/D converter 62, in turn, is arranged to send signals to the microcomputer 53, either through a hard-wired connection or via a wireless transmission. Alternatively, the A/D converter 62 may be a contained within the microcomputer 53 in a manner known in the art.

The fixed series resistor 56 may be, for example, a 100K ohm resistor. The A/D converter 62 is configured to convert an analog voltage reading from the juncture 60 to a digital value representing the voltage at the juncture. Because the temperature sensing element's resistance varies with temperature, the voltage at the juncture 60 also varies with temperature. As further described below, the change in voltage information may be used to adjust the heat output of the electric heating element 24 in accordance with temperature changes in the blanket 122.

In accordance with one aspect of the present invention, the digital information generated by the A/D converter 62 is used to represent temperature information. The digital voltage information changes with changes in temperature, because, as described above, the resistance of the temperature sensing element 28 varies with changes in the temperature of the blanket 22. The digital voltage information may therefore be used to represent the temperature of the blanket 22. This digital voltage information is used by the microcomputer 53 to determine the amount of adjustment to the heat output of the heating element 24 that is needed to offset variations in temperature of the blanket.

The microcomputer 53, the A/D converter 62, and the resistor 56 may be mounted on a conventional PC board, which in turn may be mounted in a control box for the warming blanket 120. As such, the components used in conjunction with the temperature sensing element 28 use little space and may be added to the controls for conventional warming blankets with very little modification.

The temperature sensing element 28 may be arranged relative to the blanket 22 and the electric heating element 24 in a variety of different ways. However, preferably the temperature sensing element 28 covers a large portion of the blanket so that local overheating conditions may be sensed. In one embodiment of the present invention shown in FIG. 3, the electric heating element 24 forms a sinusoidal path, with the elongate portions of the path arranged parallel to one another and aligned in a particular direction (e.g., from the head to the foot of the blanket 22). The electric heating element 24 is connected to a power source 210, and the wattage supplied by the power source is controlled by the heat output component 50, which in turn is set by the microcomputer 53.

Figure 3:
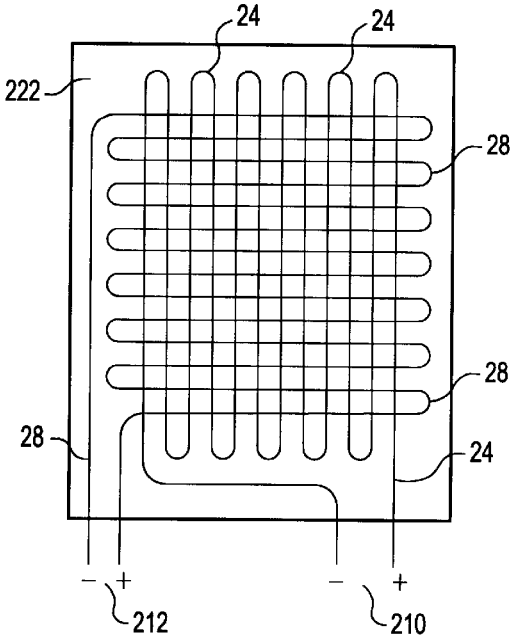
FIG. 3 is a diagrammatic representation of an arrangement for electric heating element wires and temperature sensor elements for a warming blanket in accordance with one aspect of the present invention.

In the embodiment shown in FIG. 3, the temperature sensing element 28 also loops back and forth across the blanket 22 in a sinusoidal pattern, with elongate portions of the element arranged parallel to one another and aligned transverse to the electric heating element 24 (e.g., from the side edge to side edge of the blanket 22). In the embodiment shown, the temperature sensing element 28 is aligned perpendicular to the electric heating element 24, but the temperature sensing element 28 may be otherwise transverse to the electric heating element (e.g., aligned at an acute angle to the electric heating element). A power source 212 applies a voltage across the temperature sensing element 28, such as 5 volts DC, and, as described above, the opposite end of the PTC sensor is connected to a resistor 56 (not shown in FIG. 3).

The embodiment shown in FIG. 3 is particularly advantageous in that the temperature sensing element 28 covers most of the blanket. Moreover, because the temperature sensing element 28 is arranged transversely to the electric heating element 24, it may be used to sense various areas of the blanket 22 relative to the electric heating element 24. For example, some portions of the temperature sensing element 28 run across the electric heating element 24, and others are spaced from the electric heating element. This configuration thus gives an advantage in that it permits the temperature sensing element 28 to represent an average temperature of the blanket 22.

Figure 4:
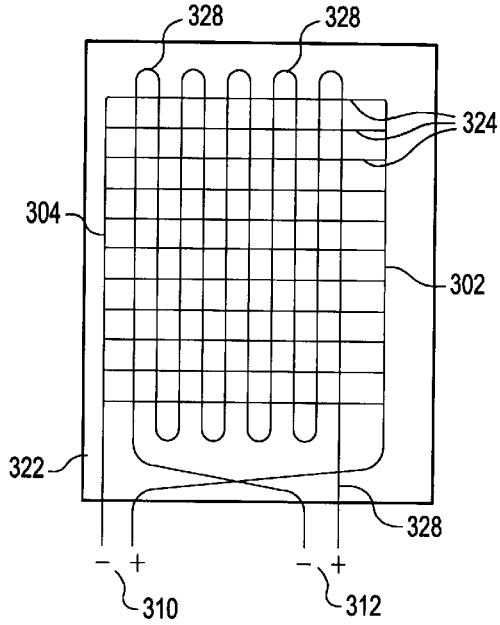
FIG. 4 is a diagrammatic representation of a another arrangement for electric heating element wires and temperature sensor elements for an alternative embodiment of a warming blanket in accordance with another aspect of the present invention.
Figure 5:
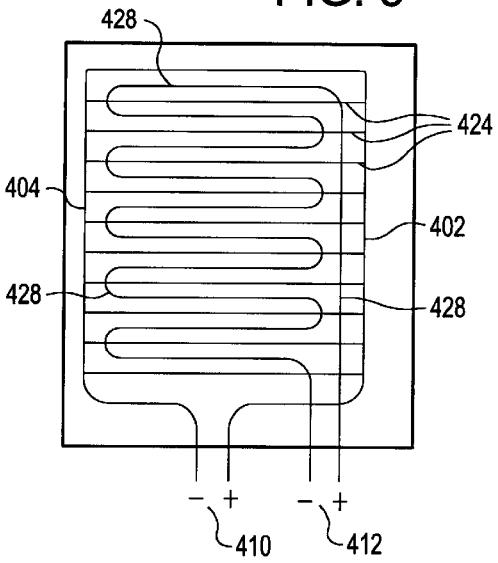
FIG. 5 is a diagrammatic representation of yet another arrangement for electric heating element wires and temperature sensor elements for another embodiment of a warming blanket in accordance with another aspect of the present invention.

Two more embodiments are shown in FIGS. 4 and 5. For each of these embodiments, a pair of bus wires 302, 304 (FIG. 4), or 402, 404 (FIG. 5) are connected to a power source 310 (FIG. 4) or 410 (FIG. 5). Heat element wires 324 or 424 extend between the two bus wires 302, 304 or 402, 404, and extend parallel to one another. In the embodiment shown in FIG. 4, the temperature sensing element 328 extends transversely across the heat element wires 324, and in FIG. 5 the temperature sensing element 428 extends parallel to the heating element wires 424. Both embodiments provide the benefit of temperature sensing of most of the blanket, and the former provides the temperature sensing element aligned transversely with the heating element wires, the benefit of which is described above.

Figure 6:
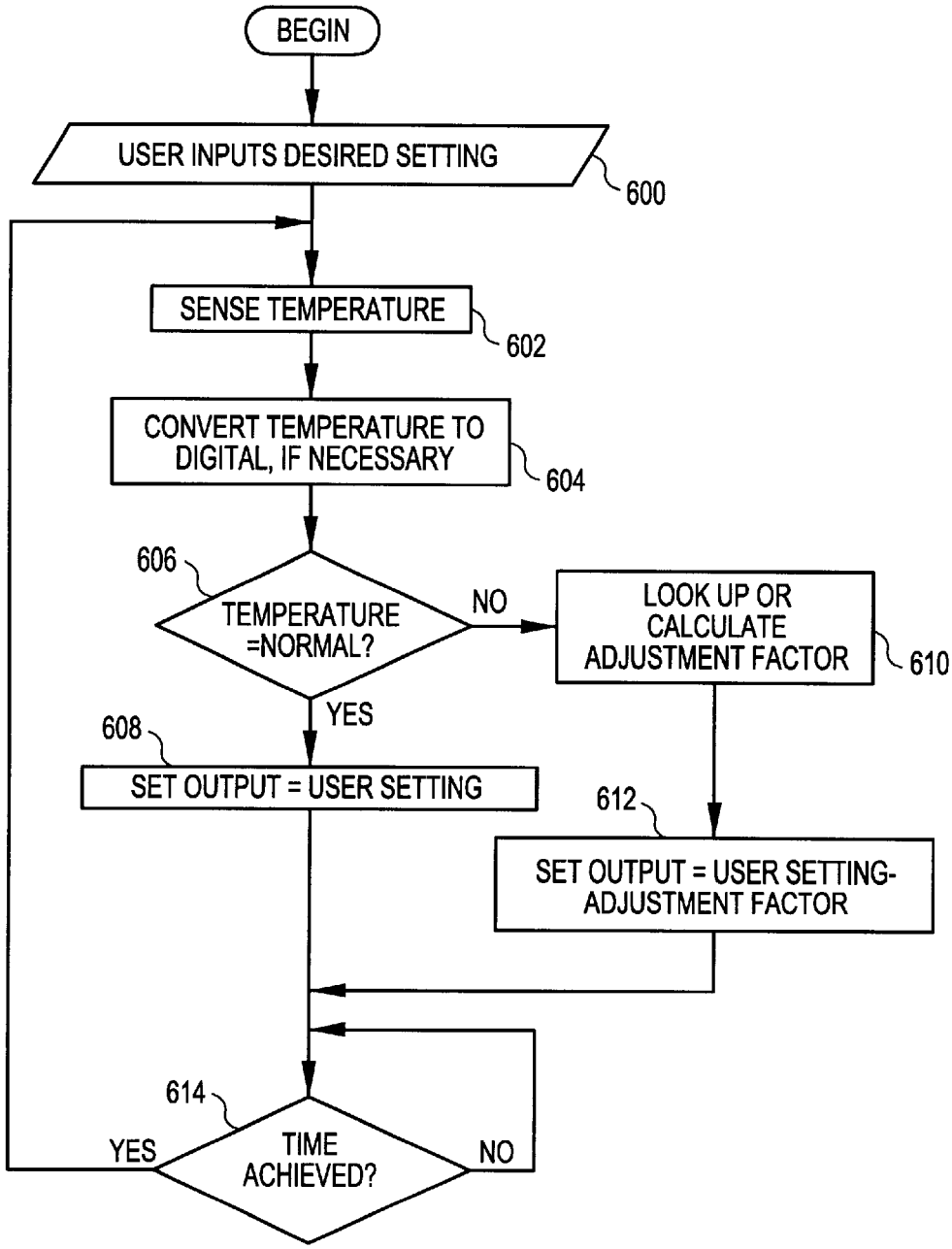
FIG. 6 is a flow diagram generally representing steps of operation of the controls of the warming blanket of FIG. 1 in accordance with one aspect of the present invention.

FIG. 6 shows a general overview of operation of the temperature compensation controls of the warming blanket 20 in accordance with one aspect of the present invention. For ease of understanding, the flow process is described as shown in FIG. 6. It can be understood that the steps shown may be combined, performed in different orders, or one or more of the steps may be skipped and the process may still fall under the present invention as defined in the claims below.

Beginning at step 600, a user enters a desired setting (e.g., via the user control 36). The setting represents a comfort level chosen by the user, and is stored in the microcomputer 53. As an example, the user control 36 may include settings 1 to 10, with 10 being the warmest setting, and 1 being the least warm. These settings represent the heat setting of the warming blanket, and the user's selection determines the amount of power supplied to the electric heating element 24, and therefore the temperature of the blanket 22. That is, the amount of power that is supplied to the heating element 24 determines the heat output of the warming blanket 20.

As one example, the settings may represent the amount of time (the "duty cycle") that power is supplied to the electric heating element 24 during a fixed time period, such as 90 seconds. For a setting of 10, the time that power is supplied to the heating elements during the time period is longer than a setting of 9, 9 is longer than 8, and so forth. As one example, at the setting 10, the power may be supplied to the blanket for the entire time period. For a low setting, such as 1, the power may be supplied for only 10% (i.e., in the example above, 9 seconds) of the duty cycle. The remaining settings may increase the duty cycle linearly as the setting increases (e.g., 20% at 2, 30% at 3, and so forth). The microcomputer 53 may be programmed by a programmer of skill in the art to provide the heat output settings and other functions described herein.

Operating a warming blanket at different heat output settings is known, and other ways of modifying the power to the heating elements may be used, and the above is given as an example only. For example, the amount of power cycled to the heating element may be reduced, instead of the time the power is supplied to the heating element. In addition, more than one heating element or alternate arrangements for one or more heating elements may be used, and lower settings may use a first heating element, intermediate settings the second, and higher settings a combination of the two.

In any event, at step 602, the temperature of the blanket 22 is sensed by the temperature sensing element 28. If desired, power may be supplied intermittently to the temperature sensing element 28 to provide a voltage reading at the juncture 60 so that temperature readings may be provided at intervals. Alternatively, voltage (and therefore temperature) may be sensed constantly, by constantly supplying power to the temperature sensing element 28 during operation so that as long as the warming blanket 20 is operating, a voltage is supplied to the juncture 60. If necessary, the temperature information is converted to digital in step 604 (e.g., by the A/D converter 62).

At step 606, a determination is made whether the temperature is normal. That is, based upon the temperature data (i.e., in the example given, the voltage reading) provided by the temperature sensing element 28, the microcomputer determines whether the temperature falls within a normal range for the selected user setting, and, based upon that determination, decides whether an adjustment needs to be made to the heat output of the blanket 22 to compensate for the temperature at the time of the sensing the temperature. If desired, temperature readings may be taken only after the blanket is expected to reach normal operating temperatures (e.g., beginning 5 minutes after the warming blanket is turned on).

If PTC material is used for the temperature sensing element 28, then the voltage at the juncture 60 will decrease as the temperature increases. The allowed normal temperature may then be, for example, a minimum voltage for the juncture 60. The minimum voltage reading for a particular blanket setting may be determined by empirical data, and may be stored as data in a lookup table 52 (FIG. 2) or as an algorithm.

If the temperature is normal, i.e., falls within the normal range, then step 606 branches to step 608, where the heat output of the blanket is set to the normal (i.e., non-temperature adjusted) output that corresponds to the user's setting. As one example, the user may have set the user control 36 to the setting "5," and the temperature of the blanket is 70 degrees, which for this example is within the normal temperature range of the blanket 22 at that setting. As such, using the example of operation of the controls of the warming blanket 20 described above, the heat output of the warming blanket is set to the normal setting for a "5," wherein power is cycled to the blanket 50% of the time. Such instructions are sent by the microcomputer 53 to the heat output component 50, which performs the heat output functions of the microcomputer's instructions.

If the temperature is not normal, i.e., falls outside the normal range, then step 606 branches to steps 610 and 612, where the heat output of the blanket is adjusted to account for the amount the temperature is varied from normal. As an example, beginning at step 610, an adjustment factor is calculated by the microcomputer 53 for the heat output of the warming blanket 22. The adjustment factor may use one of many mechanisms used by the microcomputer 53 to calculate an appropriate adjustment to the heat output. The adjustment factor may, for example, be stored in a look-up table 52 by the microcomputer 53 using the voltage values from the A/D converter 62.

As one example, as a result of an abnormal low voltage (i.e., high temperature) reading, the microcomputer 53 may adjust the power output downward to the blankets lowest setting. As another example, the microcomputer 53 may cut power to the electric heating element 24. In still another example, the microcomputer 53 may adjust the wattage supplied to the electric heating element 24 based upon exactly how low the temperature (i.e., voltage reading) is below normal. Using the example given above, if the user has set the control to "5," and the temperature of the blanket 22 has risen to cause the voltage reading to be slightly below normal, the microcomputer 53 may adjust the power supplied to the electric heating element 24 slightly downward (for example, to cycle 40% of the time instead of 50%). The adjustment downward may be increased as the voltage drops even more.

The amount that the output to the electric heating element 24 is adjusted may be determined empirically, and may be stored as an appropriate algorithm so that the microcomputer 53 may calculate the appropriate adjustment on the fly, or the adjustment values may be stored and accessed via a look-up table (e.g., by comparing the voltage values from the A/D converter 62 and the users settings to ranges of values stored in the lookup table, and adjusting according to the difference between normal values and the measured value). In accordance with one aspect of the present invention, when the user sets the user control 136 to the lowest setting, and the voltage drops below the normal range for that setting, the adjustment factor does not adjust the heat output downward, but instead cuts all power to the heating element. Power may be restored when the voltage is restored above the minimum value.

There are a number of different situations that may cause the temperature sensed by the temperature sensing element 28 to be higher, and therefore the voltage to drop. For example, the blanket 22 may be folded over too many times, causing a local overheating. Such a situation would cause the temperature to rise locally. However, because the temperature sensing element 28 extends through most of the blanket, the local rise in temperature would cause a corresponding rise in the resistance of the temperature sensing element at that location, resulting in a lower voltage reading. As another example, if too much bedding is piled onto the blanket 22, heat dissipation may be limited, and a large portion of the blanket temperature may rise. In this example, the voltage reading would also drop, because the temperature of the temperature sensing element 28 would rise throughout the blanket. Because the temperature rises over much of the blanket in the second example, the temperature may not have to rise as much for the voltage to drop below "normal."

At step 612, the heat output is adjusted according to the adjustment factor by lowering the heat output according to the algorithm or information in the lookup table. Using the example described above, if the user sets the user control 36 to the setting "5" and the voltage reading for the blanket at that temperature corresponds to adjusting power supply to the blanket from a 50% to a 40% duty cycle, the heat output component 50 would therefore operate the blanket 122 so that power is supplied to the heating element 24 for 40% of the time. Thus, the microcomputer 53 may be programmed to cause the blanket 22 to operate at a lower heat output at the higher temperatures to provide less warming. This lower heat output causes the blanket to remain at a comfortable temperature for the user.

Adjusting the heat output to compensate for temperatures is preferably invisible to a user for the case where a large portion of the blanket is overheated. The blanket remains at the same temperature, but with less power supplied to the heating element 24. In the case of local hot spots, however, the blanket temperature may have to drop to an uncomfortably low level or may even be turned off to avoid overheating. By doing so, the blanket temperature may be warning the user that excessive folding or unsafe conditions exist, so that the user may rearrange the blanket or adjust the blanket as necessary. If desired, an alarm may sound, the warming blanket 20 may be shut off, or the microcomputer 53 may otherwise handle an overheating situation.

After heat output is set by the microcomputer 53 (either at step 608 or step 612), then the process branches to step 614, where a determination is made whether it is time to check the temperature again. If so, the process branches back to step 602, where the temperature is sensed again. In this manner, the temperature compensation features of the present invention may be used in real time, so that adjustments may be made to heat output as the temperature changes. Additional temperature sensings may be made in set intervals, or by firing of events, in manners known in the art.

Figure 7:
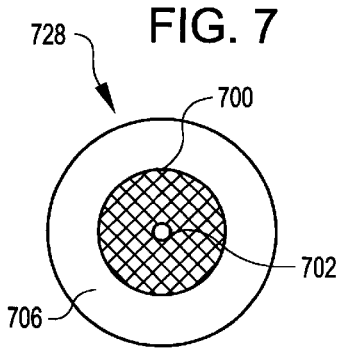
FIG. 7 is a cross section of a temperature sensing element formed in accordance with one aspect of the present invention.

In accordance with one aspect of the present invention, as shown in FIG. 7, to form a temperature sensing element 728, a PTC compound 700 is extruded onto a nonmetallic core 702. By being nonmetallic, the core 702 is more flexible, and the entire PTC sensor 728 may be extruded in a thinner profile than can be produced with a metal core. The PTC temperature sensing element 728 is lighter than would be the case if the PTC material was extruded onto a metallic core, and the core 702 of the PTC temperature sensing element does not have to be insulated from the PTC compound 700. The core material preferably is flexible and has sufficient tensile strength to not be broken within the blanket 22. As one example, the core 702 may be a polymeric material, such as a yarn made from polyester, nylon, polyethylene, polypropylene, cotton, polyacrylic/cotton blends, etc. as examples. The polymeric yarn may optionally be coated with an electro-conductive adhesive or coating such as Electrodag 154 from Acheson Colloids. In addition, an optional insulating layer 706 may be added on the outer surface of the PTC compound.

In a more specific embodiment, the core 702 is a 1100 to 1200 denier polyester yarn that is extruded with a carbon black loaded polyolefinic PTC compound. It should be recognized that other suitable semi-crystalline polymers in combination with carbon black may also be suitable for temperature sensing means. These include blends of polyolefinic materials with amorphous polymers as well as homopolymers of polytetrafluroethylene and copolymers of vinylidene fluoride. The PTC compound may include 10–55% carbon black by weight of the total polymeric matrix to modify the electrical resistance. An electroconductive adhesive is applied to the outer surface of the yarn before applying the PTC compound.

In one embodiment, the temperature sensing element has a resistance of approximately 200,000–575,000 ohms/100 feet at 75 degrees Fahrenheit, a higher resistance at higher temperatures (e.g., 240,000–725,000 ohms/100 feet at 90 degrees Fahrenheit), and a much higher resistance at higher temperatures (e.g., 360,000 ohms–1,200,000 ohms/100 ft. at 104 degrees Fahrenheit). (Above values are listed for example purposes only and may not represent the full range of the temperature sensing element's capabilities.) While the resistance of the temperature sensing element typically does not vary linearly with changes in temperature, its variation is predictable.

The present invention provides a warming blanket 20 that is capable of altering heat output to compensate for changes in the temperature of the blanket. The result is a warming blanket that provides safety from local hot spots. In addition, the warming blanket 20 adjusts accordingly to avoid overheating of an entire blanket, so that the blanket feels approximately the same warmth at the same setting regardless of a possible blanket overheating situation.

Many variations are possible. For example, as described above, the microcomputer 53 may use different ways of setting the amount of heat output. Although a preferred embodiment is described, many subsets of the components in the preferred embodiment may be used without the other components. For example, a warming blanket may utilize the temperature sensing and compensation components of the present invention, but not have user controls. In such an embodiment, a user does not have the option to change settings for the blanket (e.g., a single setting is fixed), but the heat output changes with changes in temperature. Moreover, although the various components are shown and described herein as separate components because of certain benefits resulting from separated functionality, it can be readily appreciated that some or all of the components may be combined into more complex components, and/or may be separated even further into additional components. As one example, more than one microcomputer may be used for the various functions described herein. However, that being said, one of the salient features of this invention is the fact that the microcomputer 53 and the resistor 56 may be incorporated in a printed circuit board with conventional controls for a warming blanket, thus minimizing additional costs and space needed for controls.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A warming fabric, comprising:

a fabric;

a heating element aligned along the fabric and configured to heat the fabric;

a temperature sensing element independent of the heating element and configured to generate data regarding a temperature of the fabric; and a microcomputer configured to set the level of heat output of the heating element based at least partly upon the data generated by the temperature sensing element.

2. The warming fabric of claim 1, wherein the microcomputer sets the level of heat output of the heating element at least partly by differentiating the temperature information relative to a particular temperature, and adjusting the level of heat output based upon a difference between the particular temperature and a temperature of the fabric.

3. The warming fabric of claim 1, wherein the temperature sensing element is connected in series with a fixed-series resistor.

4. The warming fabric of claim 3, wherein the data regarding a temperature of the fabric comprises a voltage reading at a juncture of the temperature sensing element and the fixed-series resistor.

5. The warming fabric of claim 4, further comprising an A/D converter for converting the voltage reading to digital.

6. The warming fabric of claim 4, wherein the microcomputer utilizes the voltage reading to set the heat output.

7. The warming fabric of claim 1, wherein the temperature sensing element comprises a positive temperature coefficient compound extruded onto a nonmetallic core.

8. The warming fabric of claim 7, wherein the nonmetallic core comprises a polymeric material.

9. The warming fabric of claim 8, wherein the polymeric material comprises a yarn.

10. The warming fabric of claim 1, wherein the wife-heating element extends transversely across the temperature sensing element.

11. A warming fabric, comprising:

a fabric;

a heating element configured to heat the fabric and extending across the fabric in a sinusoidal pattern;

a temperature sensing element configured to generate data regarding a temperature of the fabric and extending across the fabric in a sinusoidal pattern transversely across the sinusoidal pattern of the heating element; and a microcomputer configured to set the level of heat output of the heating element based at least partly upon the data generated by the temperature sensing element.

12. The warming fabric of claim 11, wherein the sinusoidal pattern of the heating element extends primarily perpendicular to the sinusoidal pattern of the temperature sensing element.

13. A warming fabric, comprising:

a fabric;

a heating element aligned along the fabric and configured to heat the fabric, comprising resistive wire extending between first and second wire busses that extend along opposite sides of the fabric;

a temperature sensing element configured to generate data regarding a temperature of the fabric; and a microcomputer configured to set the level of heat output of the heating element based at least partly upon the data generated by the temperature sensing element.

14. The warming fabric of claim 13, wherein the heating element comprises a plurality of wires extending between the first and second wire busses.

15. The warming fabric of claim 14, wherein the temperature sensing element extends across the fabric in a sinusoidal pattern, and wherein the sinusoidal pattern is aligned primarily transversely across the plurality of wires.

16. A warming fabric, comprising:

a fabric;

a heating element aligned along the fabric and configured to heat the fabric;

a temperature sensing element independent of the heating element and comprising a positive temperature coefficient compound extruded onto a nonmetallic core and configured to generate data about the temperature of the fabric; and a microcomputer configured to set the level of heat output of the heating element based at least partly upon the data generated by the temperature sensing element.

17. The warming fabric of claim 16, wherein the nonmetallic core comprises a polymeric material.

18. The warming fabric of claim 17, wherein the polymeric material comprises a yarn.

19. A warming fabric, comprising:

a fabric;

a heating element aligned along the fabric and configured to heat the fabric; and a positive temperature coefficient temperature sensing element independent of the heating element and configured to generate data regarding a temperature of the fabric and aligned transversely across the heating element.

20. A warming fabric, comprising:

a fabric;

a heating element configured to heat the fabric and extending across the fabric in a sinusoidal pattern;

a positive temperature coefficient temperature sensing element configured to generate data regarding a temperature of the fabric and aligned across the fabric in a sinusoidal pattern transversely across the sinusoidal pattern of the heating element.

21. The warming fabric of claim 20, wherein the sinusoidal pattern of the heating element extends primarily perpendicular to the sinusoidal pattern of the temperature sensing element.

22. A warming fabric, comprising:

a fabric;

a heating element aligned along the fabric and configured to heat the fabric, the heating element comprising resistive wire extending between first and second wire busses that extend along opposite sides of the fabric; and a positive temperature coefficient temperature sensing element configured to generate data regarding a temperature of the fabric and aligned transversely across the heating element.

23. The warming fabric of claim 22, wherein the heating element comprises a plurality of wires extending between the first and second wire busses.

24. The warming fabric of claim 23, wherein the temperature sensing element extends across the fabric in a sinusoidal pattern, and wherein the sinusoidal pattern is aligned primarily transversely across the plurality of wires.

* * * * *